US006110632A

United States Patent [19]

Dunford et al.

[11] Patent Number: 6,110,632

[45] Date of Patent: Aug. 29, 2000

[54] TONER CONTAINING INORGANIC CERAMIC COLOR

[75] Inventors: Dominic Manton Dunford, Hove; Desmond Gerard Eadon, Staffs; Iona Gwawr Evans, High Wycombe; Geraldine Bridget Martina Hogan, Staffs; Joanne Margaret Holloway, Herts; David Gregory Richards, Lancs; Andrew Edward Sutton, Kidlington, all of United Kingdom

[73] Assignee: Cookson Matthey Ceramics PLC, London, United Kingdom

[21] Appl. No.: 09/242,222

[22] PCT Filed: Jul. 7, 1997

[86] PCT No.: PCT/GB97/01853

§ 371 Date: Jun. 22, 1999

§ 102(e) Date: Jun. 22, 1999

[87] PCT Pub. No.: WO98/01793

PCT Pub. Date: Jan. 15, 1998

[30] Foreign Application Priority Data

Jul. 10, 1996 [GB] United Kingdom ..... 9614494

[51] Int. Cl.[7] ..... G03G 9/00

[52] U.S. Cl. ..... 430/106; 430/137

[58] Field of Search ..... 430/106, 137

[56] References Cited

U.S. PATENT DOCUMENTS

| | | | |
|---|---|---|---|
| 4,623,602 | 11/1986 | Bakker et al. | 430/106 |
| 5,948,471 | 9/1999 | Zimmer | 427/218 |

FOREIGN PATENT DOCUMENTS

| | | |
|---|---|---|
| 0035187A2 | 9/1981 | European Pat. Off. . |
| 0035187B1 | 9/1981 | European Pat. Off. . |
| 647995A1 | 9/1994 | European Pat. Off. . |
| 631196A1 | 12/1994 | European Pat. Off. . |
| 4041358A1 | 7/1992 | Germany . |
| 62-002272A | 1/1987 | Japan . |
| 62-067558A | 3/1987 | Japan . |
| 8-119668 | 5/1996 | Japan . |
| 8-146819A | 6/1996 | Japan . |
| 2021794A | 12/1979 | United Kingdom . |

*Primary Examiner*—Mark Chapman
*Attorney, Agent, or Firm*—Ratner & Prestia

[57] ABSTRACT

The present invention is directed to electrostatic printing toner particles comprising 71 to 90 weight percent of inorganic ceramic color and 29 to 10 weight percent of an organic polymeric material. A two-part developer comprising a carrier and the ceramic toner is characterized in that the ceramic toner is present in an amount of about 2 to 24 weight percent of the developer and the toner comprises 50 to 85 weight percent of the inorganic ceramic color and 50 to 15 weight percent of polymeric material. Typically, the ceramic color comprises a ceramic pigment and a glass frit.

23 Claims, No Drawings

TONER CONTAINING INORGANIC CERAMIC COLOR

This application is the U.S. national-phase application of PCT International Application No. PCT/GB97/01853.

The present invention concerns improvements in printing, more especially it concerns improvements in transfer or direct printing of ceramic colours onto substrates.

It is well established to screen print inks or suspensions of ceramic colours onto water-slide paper in order to form decals. Such decals are used for the decoration of ware such as table china and porcelain, for domestic or hotel/restaurant use, tiles, giftware and promotional ware, earthenware objects, glass and glass ceramics and vitreous enamelled metals by well established procedures including wetting the decal to release the printed pattern. positioning the decal on the ware and then firing the combination to produce a durable decoration on the surface of the ware. This technology can be used for highly decorative colour prints yielding high value decorated objects. However, the screen printing process requires the preparation of a separate screen for each colour, extended drying times for the inks used and may create environmental problems arising from the solvents released from the inks during drying, and possible dimensional changes to the paper substrate.

It has been proposed, almost from the introduction of electrostatic photocopiers, to use photocopying onto conventional water-slide paper in order to produce decals in a rapid manner and without the use of solvent-based inks. We mention the following published patent specifications as examples of these prior proposals: GB 2151189. GB 2238985, DF 4041358. DE 3917156 and EP 647885.

Other proposals have been identified recently, namely JP08-119668 (Konica), JP08-11496 (Brother) and EP 751434 (Ricoh). These proposals are from photocopier manufacturers and, in our view, fail to teach decals that can be fired onto ware with reliable colour, gloss and density.

It has been proposed to incorporate coloured pigments in toner particles for two-part developers (see Xerox Corporation EP 22638), but no guidance is given regarding pigment content except for carbon black, for which 10% is quoted. We believe that state-of-the-art colour photocopier toners exclusively use organic pigments or dyes in concentrations below 10% by weight. eg 3 to 5 wt %. Where inorganic pigments have been used, eg black magnetic toner particles, we believe that quantities of from 20 wt % up to 60 wt % may be used.

The prior proposals to print decals have not, however, been adopted commercially, despite the apparent desirable characteristics of a photocopying-based process. We believe that certain of the problems found in such prior proposals have been either difficulty in depositing adequate colour density or, where a thick deposit of toner has been deposited, difficulty in applying the decal because of brittleness, reticulation of the covercoat, and in firing the decal without bubbling and distortion caused by the organic material in the toner. Our own tests have shown that the use of a photocopying process is far from straightforward, and that there remains a need for a commercially acceptable ceramic printing process based on electrostatic or electrophotographic printing.

It must be understood that conventional photocopying or laser printing processes and equipment are intended to produce a permanent print on paper, for which fixing the toner onto the paper by heat fusion and, usually, pressure, forms an essential part. For decal manufacture, the pigment or toner deposit may be regarded as temporary, and a covercoat provides integrity.

The terms "electrostatic printing" as used hereinafter, is intended to cover the broadest possible scope, including charged area development, discharged area development or development by charging an insulating surface, including electrography or ionography.

The present invention now provides electrophotographic printing toner particles comprising 71 to 90 wt % of inorganic ceramic colour and 29 to 10 wt % of an organic polymeric material.

The invention further provides a two-part developer for electrostatic printing comprising 2 to 22%, suitably 2 to 20 wt %, preferably 2 to 18 wt % more preferably 3 to 17 wt %, especially 4 to 12 wt % of the toner particles of the invention, in combination with a carrier. The upper limit may vary according to the particular ceramic colour and may therefore differ in a four-colour set. It is to be understood that the toner particles of the invention, if properly formulated, may be used in mono-component developers, especially of the non-magnetic type.

The ceramic colour is desirably a combination of a ceramic pigment and a glass frit, in a weight % of 40 to 95 wt %, preferably 60 to 90 wt % of the colour. Such ceramic pigments/glass frit combinations are generally known in the art as "enamels", in which the usual amount of frit is 60 to 90%, Suitable inorganic ceramic pigments are well known to those skilled in the art, and we refer, for example to "Classification and Chemical Description of the Complex Inorganic Pigments" 3rd Edition, 1991, published by the Dry Colour Manufacturers' Association, Alexandria, Va., U.S.A. Inorganic colours are generally metal oxides or mixed metal oxides. To be considered as ceramic pigments for use in this invention are also metal powders or flakes, especially of the precious metals, and iridescent, fluorescent or micaceous-type pigments. In some instances, it is desirable to sinter a pigment/glass frit mixture, then to crush the sintered product to the desired particle size. This may assist size classification and colour development.

Although any colour or set of colours may he used in the present invention, preferably a four-colour set of colours are used, namely cyan, black, yellow and magenta, especially for on-glaze decoration. Conveniently, the cyan and black are spinel-type colours, for example cobalt zinc aluminate blue spinel, zinc chrome cobalt aluminium spinel, iron cobalt chromite black spinel or possibly iron cobalt black spinel. Preferably, the yellow used is a pyrochlore or rutile structure, eg lead antiminate yellow pyrochlore or nickel antimony titanium yellow rutile, and the magenta is a colloidal gold colour, or a magenta colour based on silver in a zirconia lattice (see EP 651030). A non-magnetic black pigment, such as the copper chromite black may be used. The present invention includes as an aspect, such novel yellow and magenta toners which are useful for electrostatic printing.

For under-glaze or in-glaze decorationc yellow and blue zircon colours may be used and a chrome tin pink may be used.

The particular glass frit may be chosen according to the substrate ware onto which the decal is eventually fired in order to bind the colour onto the ware or into the glaze as appropriate. Thus, for example, for bone china ware the frit may be a leaded or unleaded frit. Softening point of the frit, thermal expansion and composition, may be chosen by the skilled man. In general, it may be said that the softening point of the frit should be such as to allow maturation within the temperature range of from 750 to 900° C., which are typical on-glaze enamelling temperatures for decoration on bone china, earthenware or hotelware pieces.

In certain circumstances, for example for under-glaze decoration, it may be desirable that the ceramic colour consists essentially of the ceramic pigment and the frit content may be 5 wt % or less. It is contemplated that the ceramic colour may be entirely the ceramic pigment. In order to ensure adequate durability of the decal after firing, a cover glaze layer should be then printed on top of the ceramic pattern, by any suitable method including electrostatic deposition or deposition of a slurry of ground glaze particles in an organic solvent and binder, in manner analogous to the established screen printing process. Such a cover glaze should be matched to the particular substrate ware and any glaze thereon, and this is within the competence of the skilled man.

The inorganic colour desirably has a particle size, before incorporation into the toner particles, of 0.1 to 20 μm, preferably of 0.2 to 15 μm, more preferably 0.5 to 10 μm or especially 2 to 6 μm. It may be desirable to classify the colour, after milling, to give a narrows size distribution. In general, the particle size distribution is chosen according to the application: for Lass or on-glaze application the particle sizes will be smallest, with increasing particle sizes for in-glaze then under-glaze applications.

Traditional toner production methods include particularly blending the components, extruding a molten mixture of the components to produce large particles, and milling to produce toner particles of the desired size. This process requires the polymer component to have acceptable melt flow characteristics and to have a glass transition temperature ($T_g$) well above 30° C., eg 50 to 72° C., to permit milling. Other methods incorporate spray drying, encapsulation, melt blending, extrusion and chipping, particle formation and crushing or solution polymerisation. Most desirably, a method is used which yields a more or less continuous skin or film of organic polymer around particles of ceramic colour, and for this, solution or suspension polymerisation or flocculation are preferred. Such methods are generally known in the art, but an especially preferred method is flocculation of polymer using acid addition, which is a method in use in the organic pigment industry, but it is not believed to be in commercial use for toner manufacture. The use of this method removes the restrictions of melt flow behaviour and $T_g$ on the organic polymer, required by traditional production methods. Further, we believe it to offer particular advantages in the production of highly-loaded ceramic decal toners.

The organic polymeric component of the toner particles may be any polymer which exhibits acceptable burn-out characteristics on firing and having the ability to form toners, that is having acceptable electrostatic properties and having physical properties permitting the production of toners having the required loading of ceramic colour by a suitable method. The actual polymer chosen for the organic component of the toner particles is desirably an acrylate-based oligomer or polymer including polymers of methyl methacrylate or methyl methacrylate-butyl methacrylate copolymers and including other co-polymers such as styrene- or vinyl-acrylates such as polystyrene-n-butylmethacrylate or polystyrene-n-butylacrylate, preferably 65% styrene 35% n-butyl methacrylate copolymer. Other polymers, however, may be used as alternative to, or blended with, the preferred acrylate-based materials. The organic component or components thereof may be selected from olefin polymers such as polyethylene or polypropylene, dienepolymers such as polybutadiene, polyisobutylene or polychloroprene, vinyl or vinylidene polymers such as polystyrene, styrene butyl-methacrylate copolymers, styrene-acrylonitrile copolymers, acrylonitrile-butadiene styrene terpolymers, polyvinyl butyral, polyvinylethers or polyvinyl ketones, fluorocarbon polymers such as polytetrafluoroethylene and polyvinylidene fluoride, heterochain thermoplastics such as polyamides, polyesters, polyethanes, polypeptides, casein, polyglycols, polysulphides and polycarbonates, and cellulosic copolymers such as regenerated cellulose, cellulose acetate and cellulose nitrate. In all cases, the organic component must meet the requirements set out at the beginning of this paragraph.

The toner particles contain 71 to 90wt % of total ceramic colour, that is, including glass frit. Preferred colour quantities are 71 to 82 wt %. Many of the early proposals known to us did not contain any guidance on colour content of toner particles; the earliest proposals appear to use standard commercial toners incorporating iron components. As mentioned above, we believe that standard photocopying toners incorporate about 5 to 10% of colouring matter. EP 647885 teaches a quantity of 10 to 70 wt %, but there are no working examples for further guidance. We have found that most toners containing below 60 wt % do not yield adequate colour density unless the thickness of the deposited layer is far beyond that acceptable for burn-out properties.

The particle size of the toners is desirably 2 to 40 μm, preferably 5 to 30 μm, most preferably 7 to 20 μm. Classification of the toner after manufacture may be desirable in order to remove fines and over-size particles; this may be desirable in particular to match the requirements of the print engine selected. In addition, account should be taken of the different densities of different in organic ceramic colours and components thereof.

The second part of a two-part developer is a carrier, which may be conducting (eg steel or ferrite) or non-conducting and is generally a ferromagnetic particle, such as a copper zinc ferrite, a magnetite, a strontium-based ferrite or a composite, of particle size suitably 30 to 200 μm, preferably 40 to 100 μm, most preferably about 40 to 90 μm. The carrier itself unless it is a composite, has a thin surface coating of an organic material which acts to modify the surface or the carrier particles are surface treated. The carrier must exhibit the appropriate electrostatic characteristics for the particular machine used. The machine may work in conductive magnetic brush mode or insulative magnetic brush mode. At this time, the vast majority of digital printers or laser colour photocopiers require the toner particles to acquire a negative charge and hence the carrier particles must generate a positive charge. A surface coating of an acrylic resin, styrene acrylate or modification thereof may be used in such cases. Many single colour photocopiers require the toner particles to acquire a positive charge and hence the carrier particles must generate a negative charge. A surface coating of a fluorocarbon or epoxy resin may be used in such cases. For a selected print engine, the actual carrier particles and their surface coating, and the organic component of the toner, and the additives selected, need to be chosen in order to achieve the desired charge magnitude and distribution to yield optimum development of the latent image, without carrier pull-out (ie transfer) onto the printed image, and this may be done by the skilled man, using background knowledge. He may refer to the triboelectric table as an empirical guide. In general, it may be said that a balance needs to be struck in the choice of these components, and that experiment will be necessary.

The toner used in the present invention will generally include relatively small quantities eg from about 0.1 wt % up to 7 %, preferably below 5 wt %, of other components as required, including particularly charge control or charge reversal agents and flow modifiers. Conventional charge control agents as used in the printer/photocopier industry include the nigrosine dyes, metal complexes of monoaza dyes, graphite and desirably colourless charge control agents. A standard flow enhancer is a fine fumed silica for example of 10 to 100 nanometer diameter, although other fine particles such as alumina, titanium dioxide or talc may be used if desired. The toner particles desirably incorporate the charge control agent, or they may be bound to the surface of the toner particles, but the other additives may simply be blended with the toner particles.

The present invention may utilise a variety of single colour or four-colour printing engines, which are generally commercially available at this time from companies such as Canon, Ricoh Xerox, Rank Xerox and Xeikon, and Agfa and IBM machines. In selecting a printing engine, it should exhibit, with the toners of the invention, acceptable life of machine components such as photoreceptor drum or plate and belt, sufficient resolution, good registration, grey scale or colour gradation capabilities, ability to deposit adequate amounts of the toner and not exhibit background staining. Printing according to the present invention may be carried out onto a suitable paper-type substrate, including preferably a commercial water-slide paper of the type commonly used for screen-printing decals and a waxed carrier for heat release transfers, and it is envisaged that printing may be carried out directly onto ware, tiles being the simplest substrate. In such a case, it is envisaged that it could be useful to coat the tile with a very thin layer of an organic material such as an acrylate in order to permit the surface to acquire adequate charge to accept the print of ceramic colour.

Although the majority of colour print engines utilise a four-colour set of toners, namely cyan, black, yellow and magenta, there exist certain machines that can print more than four colours and for example a printing of white may be useful to bring out highlights in an image. The use of two print engines in tandem may be used to produce eight-colour, high value, prints. It should be understood that the present invention also encompasses single colour, et black or white, printing, and that the printing may not be decorative but may consist of wording or other information in any form including bar codes. The invention also offers the possibility of printing unique or other security decals. For example, it is possible to formulate a fluorescent toner that is white, or other desired colour, under normal daylight or normal lighting conditions, but which fluoresces strongly when exposed to UV light. This offers the possibility of producing a unique identifier on all types of high value products, ranging from china and porcelain to other consumer products such as watches, television screens, video cassette recorders, etc. This may permit identification in the case of theft, or identification of counterfeit products. For convenience, however broad terms referring to coloured decorative printing are used herein.

Suitably, the deposit of toner on the substrate is in the region of 5 to 20 $\mu$m thickness per colour. If this cannot readily he achieved from the print engine used, it is envisaged that a second or multiple pass through the machine may be used. It is noteworthy that EP 647885 teaches deposits of 0.1 to 3 mm, preferably 0.3 to 0.6 mm, which is 300 to 600 $\mu$m.

Conventional print engines utilise a heated roller to fix the image onto the paper. We have found that certain machines use a thin film of a silicone oil on such a roller, and that small quantities of such oil are transferred onto the printed pattern and interfere with the adherence of a conventional acrylate-based covercoat. It is preferred to use a covercoat to give integrity to the printed pattern, especially for water-slide transfers, and such a covercoat is well known in the production of screen-printed transfers. A covercoat may be applied to an electrostatic transfer according to the invention, preferably using the conventional method of screen printing a solution of covercoat. It is envisaged that an electrophotographic printing of solid covercoat may be developed.

The invention thus also contemplates modifying the print engine to dispense with the heated roller, and using a non-contact fixing or fusing means such as an infra-red heater or a flash heater to bring the organic polymer component of the toner after deposition of the pattern to fusing or consolidation temperature. As an alternative, and bearing in mind that the presently preferred method of production widens the polymer type usable and also that the final print is not intended to be fixed permanently to the paper substrate it is envisaged that the present invention may dispense completely with fixing the printed pattern in a conventional way, and use a covercoat to coat the image or pattern and give it sufficient integrity for subsequent handling. Thus, a covercoat solution may be applied to an unfixed print, as it emerges from the print engine providing that no damage to the printed image is done.

Although the invention has operated successfully in trials on the basis of photocopying a master pattern, it is believed to offer particular advantages when the printing engine is controlled digitally. Many colour photocopiers have an optional extra of a computer interface, which enables a computer to control the movement of the laser used to form the latent image in the photocopier. Thus it is possible for an original piece of artwork to be scanned and converted into a digital record, so that the print engine uses a digital memory record rather than a master pattern. Once the image is digitised, there are huge possibilities for modification of the image, ranging from simple size change, through colour changes, merging with other images, to serial changes in successive printings. Transmission of a digitised image is also facilitated. The production of very small runs of printed patterns becomes economic.

The invention is believed to offer particular advantages at this time when used with equipment based on laser printers or photocopiers, but is not to be considered as limited thereto, and may for example be used with analogous electrostatic or electrophotographic printing systems.

The printed ceramic pattern produced by the invention may be used in broadly conventional manner. If the pattern is printed onto a waxed heat release paper, a heated deformable hemisphere of silicone rubber may be applied to the pattern so that the wax softens to the extent that the pattern has greater adherence to the silicone rubber than to the paper, and hence the pattern may be lifted off-the paper, the silicone rubber hemisphere moved over a substrate such as a ceramic plate, and applied so that the pattern is adhered to the substrate. As has been mentioned above, the invention may be used for direct printing especially of tiles, but the presently preferred application of the invention is to produce transfers on water-slide paper. In all cases, when the pattern is applied to substrate ware, the ware needs to be fired in a kiln to cause the coloured pattern to fix into the ware surface or into a glaze, as the case may be. These steps are conventional and well known to the man skilled in the art. The present invention may find use in the production of decals for on-glaze decoration, under-glaze or in-glaze decoration, for sanitary ware, glass (both decorative and toughened, eg automotive glass or architectural glass) or enamelled steel.

In another embodiment, the present invention provides a two-part developer composition comprising a carrier and a ceramic toner, characterised in that the toner is present in an amount of from 3 to 17 wt %, of the composition and said toner comprises 50 to 80 wt % of inorganic colour and 40 to 20 wt % of polymeric material.

Preferably, the toner contains 65 to 75 wt % of inorganic colour.

The present invention will now be more particularly described by way of example only, in which all particle size measurements refer to a $D_{90}$ unless stated otherwise and were measured on a Malvern Mastersizer X using version 1.1 software. Colour measurements were carried out on a Datacolour International Spectraflash 500 using Chroma QC version 3 software. Measurements were taken in the reflectance mode with D65 illumination and a 10° standard observer angle employed with a small circular aperture of radius 12 mm. Thermogravimetric analysis was carried out using a Stanton Redcroft ST780 instrument, with Trace software version 4.0.

EXAMPLE 1

Cyan Toner Containing 75 wt % Ceramic

This is an unoptimised toner with retard to composition, triboelectric charge, particle size and flow.

No additional charge control or flow agents arc added.

45 g of a Cookson Matthey Ceramics and Materials Ltd (CMC) cyan enamel (97N4000) was dispersed in 300 ml distilled water using a conventional laboratory magnetic stirrer. 33 g of an aqueous acrylate polymer dispersion (Rohm and Haas E2976—45% solids) was added to this with stirring. 6 ml of 2M hydrochloric acid was added over 2 minutes with rapid stirring. Stirring was continued and the flocculated slurry was heated to 90° C. for approximately 2 minutes. The heat was turned off and the suspension allowed to cool to room temperature with continuous stirring. The solid material was tiltered through a conventional Whatman 541 filter paper, washed thoroughly with distilled water and dried overnight at room temperature in air. Alternatively, the solid material may be dried in an oven, in a vacuum oven, using infra red heating or other technique.

The dried material was passed through a 38 micron sieve,

The particle size distribution and triboelectric charge of the powder is given in Table 1.

Printing Trials

The powder was mixed with a commercial carrier (Ricoh FT developer, type 410) to produce approximately 3 wt % toner in the developer.

Print trials were carried out on a Ricoh FT4418 machine using the "medium" setting. Images were obtained on standard paper and waterslide paper. Samples of the decals were covercoated and transferred to porcelain ware. This was fired using a conventional cycle (150° C./hour to 810° C. soak for 1 hour and cool).

Good adherence and colour strength (see Table 1) were obtained. The colour obtained is very similar to that of the screen printed standard.

EXAMPLE 2

Cyan Toner Containing 85 wt % Ceramic

This is an unoptimised toner faith regard to composition, triboelectric charge and particle size.

No addition charge control or flow agents are added.

51 g of a CMC cyan enamel (97N4000) was dispersed in 300 ml of distilled water using a conventional laboratory magnetic stirrer. 20 g of an aqueous polymer dispersion (Rohm and Haas, Primal E2976) was added to this with stirring. 6 ml of 3M hydrochloric acid was added over 2 minutes with rapid stirring. Stirring was continued and the flocculated slurry was heated to 90° C. for approximately 2 minutes. The heat was turned off and the suspension allowed to cool to room temperature with continuous stirring. The solid material was filtered through a conventional Whatman 541 filter paper, washed thoroughly with distilled water and dried overnight at room temperature in air.

The dried material was passed through a 38 micron sieve.

The particle size distribution and triboelectric charge of the powder is given in Table 1.

Print Trials

The powder was mixed with a commercial carrier (Ricoh FT developer, type 410) to produce 3 wt % toner in the developer.

Print trials were carried out on a Ricoh FT4418 machine using the "medium" setting. Images were obtained on standard paper and waterslide paper. Samples of the decals were covercoated and transferred to porcelain ware. This was fired using a conventional cycle (150° C./hour, to 810° C. soak for 1 hour and cool).

Good adherence and colour strength (see Table 1 were obtained. The colour obtained was weaker than the screen printed standard.

EXAMPLE 3

Cyan Toner Containing 75.2 wt % Ceramic

This is an unoptimised toner with regard to composition, triboelectric charge and particle size and flow.

75 g of a CMC cyan enamel (97N4000) was dispersed in approximately 300 ml distilled water. 55 g of Primal E2976 was added to this with stirring and the volume was made up to 400 ml with water. The slurry was passed through a Buchi 190 mini spray dryer using the following conditions.

| | |
|---|---|
| Inlet temperature | 246° C. |
| Outlet temperature | 60 to 70° C. |
| Feed pump | 450 ml/hr |
| Aspirator | 26.25 $m^3$/hr |
| Heater | Full |
| Carrier gas flow rate | 600 liters/hr |

The toner sample produced was collected from both the cyclone chamber and the drying column and passed through a 38 micron sieve.

Print Trials

The powder was mixed with the carrier (Ricoh Developer FT, tape 410) to produce approximately 3 wt % toner concentration. This was printed onto the waterside paper on the Ricoh FT4418 using the medium setting.

The toner was not permanently fused to the paper and could be rubbed off the paper by use of a finger nail. However, sufficient adherence was obtained to allow covercoating of the images. The decals were applied to the ware (as in Example 1). Good colour strength (see Table 2) and gloss was obtained.

EXAMPLE 4

Cyan Toner Containing 80.01 wt % Ceramic

This is an unoptimised toner with regard to composition, triboelectric charge, particle size and flow.

80 g of a CMC cyan enamel (97N4000) was dispersed in approximately 200 ml of distilled water, 44.4 g of Primal E2976 was added to this with stirring and the volume was made up to 250 ml with water. The slurry was passed through a Buchi 190 minispray dryer using the conditions given in Example 3.

The material was collected from the cyclone chamber and drying column and passed through a 38 micron sieve.

Print Trials

The toner was mixed with the carrier (Ricoh Developer FT, type 410) to produce approximately 3 wt % toner concentration This was printed onto waterslide paper on the Ricoh FT4418 using the medium setting.

The toner was not permanently fused to the paper and could be rubbed off the paper by use of a finger nail. It appeared that the fusion was lower than that in Example 3. However, sufficient adherence was obtained to allow cover-coating of the images. The decals were applied to the ware and fired (as in Example 1). Good colour strength (see Table 2) and gloss was obtained.

EXAMPLE 5

Yellow Toner Containing 73.1 wt % Ceramic

This is an unoptimised toner with regard to composition, triboelectric charge, particle size distribution and flow. This formulation contains both charge control additive and flow additive.

225 g of a CMC yellow enamel (97H4000) which is a pyrochlore yellow was dispersed in 800 ml distilled water using a Silverson stirrer at room temperature.

9 g of charge control agent (Bontron E84) and 167 ml of Primal E2976 were added to 500ml water and dispersed using a Silverson stirrer for 3 minutes.

The charge control/polymer suspension was added to the ceramic suspension with stirring. 50 ml water was used to rinse the charge control agent/polymer dispersion into the vessel. The mixture was sheared for 2 minutes. This mixture was transferred to a 3 liter reaction vessel fitted with an electric heating mantle using 1 liter of distilled water to ensure total transfer. The ceramic/charge control agent/polymer suspension was then stirred at 300 to 350 rpm using an overhead stirrer fitted with a PTFE paddle. This stirring was continued right through to the filtration stage.

50 ml of 2M HCl was placed in a dropping funnel. 100 ml water was used to rinse the measuring cylinder into the funnel. The vessel was heated to 27° C. The acid was added at a steady rate over approximately 5 minutes.

After addition of the acid, the funnel was rinsed through with a further 20 ml water. The electric heating mantle was turned on to maximum until the thermometer indicated 56° C. The heat was turned off. Final temperature of the suspension was 60° C.

100 ml water was used to rinse any solids on the wall of the flask into the vessel. The suspension was allowed to cool. Stirring was stopped below 30° C. The suspension was filtered through a Whatman 541 filter paper and washed with 4×200 ml aliquot of water.

The product was allowed to dry in air for 16 hours on the filter paper. The dry toner was sieved through a 38 micron sieve.

1 wt % silica (Degussa AG R972) was added to the toner by dry dispersion.

The total ceramic loading is calculated at 73.1 wt %.

Thermogravimetric analysis to 600° C. of the toner confirmed 73.04 wt % residue, that is, inorganic ceramic material.

Print Trials

The toner was mixed with a commercial carrier material (Xerox) to produce a 10 wt % toner concentration.

The mixture was loaded into a Ricoh NC5006 colour photocopier and printed using standard machine conditions. The fused toner decal was then covercoated and the motif was applied to porcelain ware. Good colour strength and gloss was achieved. The colour co-ordinates for a fast fired decal are given in Table 3.

EXAMPLE 6

Magenta Toner Containing 73 wt % Ceramic

This is an unoptimised toner with regard to composition, triboelectric charge, particle size distribution and flow. This formulation contains flow additive.

216 g of a CMC magenta enamel (97A4000) was dispersed in 800 ml of distilled water at room temperature in a reaction vessel fitted with an electric heating mantle.

199 g of Zeneca Resins Ltd Neocryl A-633 a commercial styrene-acrylate polymer emulsion was added to 3 liters of water and dispersed using a Silverson stirrer for 3 minutes.

The ceramic suspension was then added to the polymer with stirring. 500 ml of water was used to rinse the ceramic suspension into the vessel. The ceramic/polymer suspension was stirred at 300 to 350 rpm using an overhead stirrer fitted with a PTFE paddle. This stirring was continued right through to the filtration stage described below.

50 ml of 2M HCl was placed in a dropping funnel. The acid was added to the suspension at a steady rate over approximate 5 minutes. 120 ml of water was used to rinse the measuring cylinder and funnel into the reaction vessel. The electric heating mantle was turned on to maximum until the thermometer indicated 78° C. The heat was turned off. Final temperature of the suspension was 80° C. 100 ml of water was used to rinse any solids on the wall of the flask into the vessel. The suspension was allowed to cool. Stirring was stopped below 30° C. The suspension was filtered through a Whatman 541 filter paper and the collected solids were washed with 4×500 ml aliquot of water. The product was allowed to dry in air for 16 hours on the filter paper. The resulting dry toner was sieved through a 38 micron sieve.

1 wt % of silica (R972) was added to the toner by dry dispersion.

Print Trials

Print trials were carried out with a Xerox carrier at two concentrations: 5 and 10 wt % toner. The mixture was loaded into a Ricoh NC5006 photocopier and printed using standard machine conditions. The toner is negatively charged. The fused toner decals were covercoated and the motifs applied to porcelain ware and conventionally fired (see Example 1). Good colour strength and gloss was achieved. The colour co-ordinates for the 5 and 10 wt % prints are given in Table 4.

Examples 7 to 11 are unoptimised toners with regard to composition, triboelectric charge, particle size distribution and flow. The product toners were used as positively charged toners in a single colour machine.

EXAMPLE 7

Magenta Toner Containing 64 wt % Ceramic Printed at 3.7 wt %

40 g of a CMC magenta enamel (97A4000) was dispersed in 300 ml of distilled water with stirring. To this was added 50 g of a Primal E2976 suspension with vigorous stirring. 6 ml of 2M HCl was added dropwise over 2 minutes. The resultant slurry was then heated to 80° C. with stirring. The suspension was maintained at temperature for 5 minutes and then allowed to cool to room temperature with stirring. The solids were removed by filtration through a Whatman 541 filter paper and thoroughly washed with distilled water. The precipitate was then allowed to dry in air overnight at ambient temperature. The solids were then sieved through a 38 micron mesh.

Print Trials

The powder was mixed with a commercial (Ricoh FT developer, type 410) to produce 3 wt % toner in the developer. Print trials were carried out on a Ricoh FT4418 photocopier machine using the "medium" setting. Images were obtained on standard paper and waterslide paper. Samples of the decals were covercoated and transferred to porcelain ware. This was fired using a conventional cycle (see Example 1).

Good adherence, gloss and colour strength (see Table 5) were obtained. The colour obtained is very similar to that of the screen printed standard.

EXAMPLE 8

Yellow Toner Containing 64 wt % Ceramic Printed at 3.7 wt % Toner

Example 7 was repeated using a yellow CMC enamel (97H4000) instead of a magenta enamel.

Print Trials

Print trials identical to those described in Example 6 were carried out.

Good colour strength, adherence and gloss were obtained when the decals were fired using conventional and fast firing cycles (see Table 5).

EXAMPLE 9

Black Toner Containing 64 wt % Ceramic Printed at 3.7 wt % Toner

Example 7 was repeated using 40 g of CMC black enamel (97F4000) instead of a magenta enamel.

Print Trials

Print trials identical to those described in Example 6 were carried out.

Good colour strength, adherence and gloss were obtained on firing. Colour co-ordinates for the conventional fired ware are given in Table 5.

EXAMPLE 10

Cyan Toner (Containing 65 wt % Ceramic Printed at 3.7 wt % Toner

Example 7 was repeated using 39 g CMC can enamel (97N4000) instead of a magenta enamel and 47 g of Primal E2976.

Print Trials

Print trials identical to those described in Example 6 were carried out.

Good colour strength, adherence and gloss were obtained on firing onto ware. The colour co-ordinates for the conventional firing is given in Table 5.

EXAMPLE 11

Cyan Toner Containing 55 wt % Ceramic Printed at 3.7 wt % Toner

Example 1 was repeated using 33 g of CMC cyan enamel (97N4000) and 60 g of Primal E2976.

Print Trials

Print trials were conducted as described in Example 1. Good colour strength and adherence were obtained (see Table 5).

EXAMPLE 12

Cyan Toner Containing 66 wt % Ceramic

This is an unoptimised toner with respect to triboelectric charge, particle size distribution, flow and $T_g$.

The following reaction was carried out under a nitrogen atmosphere. The monomers were washed before use with NaOH using conventional practice.

600 ml of distilled water was placed in a multi-necked baffled reaction flask. 0.001 g of PVA in aqueous solution was added to this and the flask purged with nitrogen for 15 minutes.

0.303 g of Ser-FA196 (Huls) was weighed into a 100 ml conical flask. To this was added 10 ml of styrene (Aldrich, catalogue number 24,086-9) and 15 ml of butylmathacrylate (Aldrich, catalogue number 23,586-5) monomers. 0.75 g of benzoyl peroxide was dissolved in the monomer mixture as an initiator. 21 g of a CMC black enamel (97E4000) was added to this with stirring. The monomer/ceramic/initiator mixture was then de-gassed using a nitrogen purge. This was then added to the reaction vessel with stirring. Care was taken to minimise atmosphere ingress. The nitrogen purge was reduced and the reaction flask was immersed into a water bath pre-heated to 70° C. The reaction was continued for 4 hours with the temperature being maintained between 70 and 85° C. The mixture was then allowed to cool and filtered through a Whatman 541 filter, washed with distilled water and allowed to dry in air at room temperature.

The dry powder was then sieved through a 38 micron mesh.

Thermogravimetric analysis showed 66% residue at 600° C. A glass transition temperature of 52° C. was obtained using differential scanning calorimetry.

Print Trials

The powder was mixed with a commercial carrier (Ricoh FT developer, type 410) to produce approximately 3 wt % toner in the developer.

Print trials were carried out on a Ricoh FT4418 photocopier machine using the "medium" setting. Images were obtained on standard paper and waterslide paper. A small amount of hot offset was observed during printing. However, samples of the decals were covercoated and transferred to porcelain ware. This was fired using a conventional cycle (150° C./hour to 810° C. soak for 1 hour and furnace cool). A strong dark print was obtained, but this was patchy due to toner pull-off on the hot roller.

TABLE 1

Single-Colour Acrylate Toner Prepared by Flocculation (Positive Toner)

| Sample | wt % ceramic | Colour Co-ordinates L | C | H | $D_{90}$ microns | $D_{50}$ microns | $D_{10}$ microns | Charge q/m $\mu$C/g |
|---|---|---|---|---|---|---|---|---|
| Standard screen print | | 59.07 | 28.19 | 223.72 | — | — | — | — |
| Example 1 | 75 | 50.04 | 30.95 | 224.49 | 28.55 | 13.39 | 1.54 | 0.23 |
| Example 2 | 85 | 72.35 | 16.66 | 22.74 | 19.92 | 6.32 | 0.97 | 2.08 |
| Standard screen print | | 59.07 | 28.19 | 223.72 | — | — | — | — |
| Example 3 | 75 | 58.11 | 27.68 | 222.27 | | | | |
| Example 4 | 80 | 56.72 | 27.68 | 222.45 | | | | |

(L = lightness, C = chroma, H = hue)

TABLE 3

Four-Colour Acrylate Toner Prepared by Flocculation (Negative Toner-Containing CCA and Flow Additive)

| Sample | wt % ceramic | Colour Co-ordinates L | C | H | $D_{90}$ microns | $D_{50}$ microns | $D_{10}$ microns | Charge q/m $\mu$C/g |
|---|---|---|---|---|---|---|---|---|
| Standard screen print | | 83.84 | 49.47 | 97.99 | — | — | — | — |
| Example 5 | 73.1 | 84.12 | 52.05 | 98.37 | 20.51 | 10.77 | 1.44 | |

TABLE 4

Four-Colour Styrene Acrylate Toner Prepared by Flocculation Negative Toner Containing Flow Additive

| Sample | wt % ceramic | L | C | H |
|---|---|---|---|---|
| Standard magenta (screen print) | — | 61.21 | 14.15 | 7.04 |
| Example 6 5 wt % toner in carrier | 73 | 66.84 | 10.43 | 358.56 |
| Example 6 10 wt % toner in carrier | 73 | 61.95 | 13.25 | 3.98 |

TABLE 5

Single-Colour Acrylate Toner Prepared by Flocculation Positive Toner Containing No Charge Control Agent or Flow Additive

| Sample | wt % ceramic | L | C | H | wt % toner in carrier |
|---|---|---|---|---|---|
| Standard magenta (screen print) | | 61.21 | 14.15 | 7.04 | — |
| Standard yellow (screen print) | | 83.84 | 49.47 | 97.99 | — |
| Standard black (screen print) | | 28.57 | 1.63 | 56.15 | — |
| Example 7 Magenta-conventional fire | 64% | 64.19 | 10.13 | 358.3 | 3.7 |
| Example 8 Yellow-conventional fire | 64% | 79.58 | 44.79 | 95.54 | 3.7 |
| Example 8 Yellow-fast fire | 64% | 83.29 | 49.12 | 97.93 | 3.7 |
| Example 9 Black-fast fire | 64% | 35.34 | 2.55 | 65.79 | 3.7 |

TABLE 5-continued

Single-Colour Acrylate Toner Prepared by Flocculation Positive Toner Containing No Charge Control Agent or Flow Additive

| Sample | wt % ceramic | L | C | H | wt % toner in carrier |
|---|---|---|---|---|---|
| Example 10 Cyan-conventional fire | 65% | 58.18 | 29.31 | 224.62 | 3.7 |
| Example 11 Cyan-conventional fire | 55% | 58.28 | 28.05 | 224.76 | 3.7 |

EXAMPLES

For all the following examples, when the colour co-ordinates for the xerographic samples and screen printed standards versus are quoted, they are for the same type of ware. That is, when the colour co-ordinates are quoted for xerography on porcelain, the figures quoted for screen printing have also been measured on the same type of porcelain.

EXAMPLE 13

Fluorescent Toner Containing 64 wt % Ceramic Printed at 3.7 wt % Toner

A fluorescent enamel was prepared by wet grinding in a ball mill 10 g of a commercial phosphor (manganese-doped zinc silicate obtained from Phosphor Technology, Middle Sireet, Nazeing, Essex, EN9 2LP, United Kingdom) with 90 g of an unleaded onglaze frit.

Example 7 was repeated using 40 g of the above enamel instead of a magenta enamel.

Print Trials

Print trials identical to those described in Example 6 were carried out. Images were made of a backstamp, a bar code and a security marking. Good gloss was obtained on firing the images onto bone china. However, under visible light the image could not be distinguished from the remainder of the ware. However, on exposure to short wavelength ultra violet radiation the images fluoresced strongly (green light).

This is an example of using toner technology for security marking. By using a digital copier, every item could be marked with a unique code which would not ruin the aesthetic quality of the ware.

EXAMPLE 14

Magenta Toner Containing 64 wt % Ceramic Printed at 3.7 wt % Toner

A magenta enamel was prepared by wet grinding in a ball mill 12.5 g of CMC Cerise base with 87.5 g of a glass frit (ex Corning Glass, U.S.A.).

Example 7 was repeated using 40 g of the above enamel instead of a magenta enamel.

Print Trials

Print trials identical to those described in Example 6 were carried out. The images were fired onto a range of Corning glass-ceramic ware using the appropriate calcination cycles. Good colour strength was obtained.

EXAMPLE 15

1 kilogram Preparation of Black Toner Containing 75 wt % Ceramic

This is an unoptimised toner with regard to particle size distribution. This formulation contains flow additive.

595 g of an aqueous styrene acrylate polymer dispersion (Zeneca Neocryl A-633, 42 wt % solids) was added to 12 liters of distilled water in a 20-liter spherical reaction vessel.

750 g of a CMC black enamel (97E4000) was dispersed in approximately 3 liters of distilled water.

The enamel suspension was added to the polymer solution with stirring (overhead stirrer). A further 1 liter of distilled water was used to wash any residue into the reaction flask. 450 ml of 0.66M hydrochloric acid was added to this ceramic/polymer suspension over 2 minutes with continuous stirring. The flocculated slurry was then heated to 100° C. using an electric heating mantle. The temperature was maintained for 1 minute. After this the mantle was turned off. The suspension was allowed to cool gradually with continuous stirring. The solid material was filtered through a Whatman 541 filter paper and washed with 10 liters of tap water.

The press cake was then transferred to stainless steel drying trays and allowed to dry overnight at room temperature.

The dried powder was passed through a 38 micron sieve. 1 wt % silica (Degussa AG. Aerosil 200) was then added by dry blending.

Print Trials

The toner was mixed with a commercial carrier material (Xerox, steel) to produce a toner loading of 13.04 wt %.

This mixture was loaded into a Ricoh NC5006 colour photocopier and printed using standard machine conditions. The fused toner was then covercoated applied to porcelain ware and fired using a conventional slow fire cycle (see Example 1). Good strength and gloss were achieved (see Table 6).

A second print trial was then carried out. The toner was mixed with a commercial ferrite carrier (Xerox) to produce a toner loading of 13 wt %.

The mixture was printed using the Ricoh NC5006. Good strength and gloss were achieved.

EXAMPLE 16

2 kilogram Preparation of Yellow Toner Containing 75 wt % Ceramic

This formulation contains no charge control agent.

1.5 g of a CMC yellow enamel (97H4000) was dispersed in 2 liters of distilled water using a Silverson shearer in a 5 liters beaker. To this was added 1.19 kg of Neocry A-633. 500 ml of distilled water was used to ensure complete transfer of the polymer suspension. Shearing was continued throughout the addition. The suspension was then transferred to a 20-liter reaction flask, using a further 10 liters of water to ensure complete transfer. An overhead stirrer was used to provide agitation. 750 ml of 0.66 M HCl was added over approximately 3 minutes with stirring. The flocculated slurry was then heated to 90° C. over a 50-minute period. The heater was then turned off and the suspension allowed to cool gradually with stirring. The material was then filtered through a Whatman 541 paper and thoroughly washed with distilled water. The cake was then transferred to drying trays and allowed to dry for 3 days at room temperature (trials showed that fluid bed drying, spray drying and drum drying could all be used to accelerate drying without loss of performance. Most desirably, drying may be carried out at or above the minimum film-forming temperature, preferably with agitation.

The dried material was then air classified (Alpine 50 ATP) to break up agglomerates and remove fines (see Table 6).

1 wt % of silica (R972) was added to the toner by dry blending.

Print Trials 60 g of the toner sample was mixed with 305 g of a commercial steel carrier (Xerox) to produce 16.4 wt % toner in developer.

Print trials were carried out on a Ricoh NC5006 colour copier using standard machine conditions. The fused toner images were then covercoated, applied to a tile and fast fired (45-minute cold-to-cold 890° C. peak). Good strength and gloss were achieved (see Table 6).

A second trial was carried out using a commercial ferrite carrier (Xerox) at a 16 wt % toner loading. Good colour strength and gloss were achieved on fired motifs prepared from decals produced using the Ricoh NC5006.

A third trial was carried out using a "small" ferrite carrier (Hoganas AB) at a 16 wt % toner loading. Good strength and gloss were achieved from fired motifs prepared from decals produced on the Ricoh NC5006.

EXAMPLE 17

1 kilogram Preparation of Yellow Toner Containing 85 wt % Ceramic 850 g of a CMC enamel (97H4000) was dispersed in 1 liter of distilled water using a Silverson shearer. To this was added 357 g of Neocryl A-633. A further 339 ml of distilled water was used to ensure complete transfer of the polymer dispsersion. After mixing for 5 minutes, the suspension was transferred to a 10-liter reaction flask. 5 liters of distilled water was used to ensure complete transfer. An overhead stirrer was used to agitate the reaction. 450 ml of 0.66M HCl was added over approximately 2 minutes. The flocculated slurry was heated to 90° C. over 50 minutes. The temperature was maintained for 1 hour and the allowed to cool gradually. Stirring was maintained throughout the reaction. The cool suspension was filtered through a Whatman 541 paper, washed thoroughly with distilled water and dried at room temperature for 3 days in stainless steel drying trays.

1 wt % silica (R972) was added by dry blending.

Print Trials 80 g of the the toner sample was mixed with 300 g of a commercial carrier (Hoganas AB) to produce 21 wt % toner in developer.

Print trials were carried out on a Ricoh NC5006 colour copier. The fused decals were covercoated, applied to ware and fired. Good strength and gloss were achieved compared to screen (see Table 6).

TABLE 6

Four-Colour Styrene Acrylate Toner Prepared By Flocculation Negative Toner-Containing Flow Additive

| Sample | wt % Ceramic | L | C | H | wt % Toner in carrier | $D_{10}$ micron | $D_{50}$ micron | $D_{90}$ micron |
|---|---|---|---|---|---|---|---|---|
| Standard Black (screen print) | | 28.57 | 1.63 | 56.15 | — | | | |
| Standard Yellow (screen print) | | 89.6 | 53.0 | 96.9 | — | | | |
| Example 15 Black-Fast fire | 75% | 35.42 | 1.49 | 39.22 | 13.04 | | | |
| Example 16 Yellow-fast fire | 75% | 89.1 | 49.8 | 99.4 | 16.5 | 0.53 | 6.8 | 12.5 |
| Example 17 Yellow-fast fire | 85% | 87.2 | 64.9 | 91.8 | 21 | 0.84 | 9.2 | 17.2 |

What is claimed is:

1. Electrostatic printing toner particles comprising 71 to 90 wt % of inorganic ceramic colour and 29 to 10 wt % of an organic polymeric material.

2. Toner particles according to claim 1, wherein the organic material comprises an acrylic polymer.

3. Toner particles according to claim 2, wherein the acrylic polymer is a polymer or copolymer of methyl methacrylate and butyl methacrylate.

4. The toner particles of claim 1 wherein the ceramic colour is a pyrochlore or rutile structure yellow.

5. The toner particles of claim 1 wherein the ceramic colour is a colloidal gold magenta or a silver in zirconia lattice magenta.

6. The toner particles of claim 1 wherein the colour has a particle size of 0.1 to 20 μm.

7. Toner particles according to claim 6, wherein the colour has a particle size of 0.2 to 15 μm.

8. Toner particles according to claim 7, wherein the colour has a particle size of 0.5 to 10 μm.

9. Toner particles according to claim 8, wherein the colour has a particle size of 2 to 6 μm.

10. Toner particles according to claim 1, having a majority of particles in the size range from 2 to 40 μm.

11. Toner particles according to claim 10, having a majority of particles in the size range from 5 to 30 μm.

12. Toner particles according to claim 11, having a majority of particles in the size range from 7 to 20 μm.

13. Toner particles according to claim 1, formulated to act as a mono-component developer.

14. A two-part developer for electrostatic printing of ceramic decoration, comprising 2 to 22 wt % of the developer, and toner particles according to claim 1.

15. A two-part developer according to claim 14, comprising 2 to 20 wt % of the developer of toner particles.

16. A developer according to claim 14, wherein the amount of the toner particles is 3 to 17 wt % of the developer.

17. The use of a two-part developer according to claim 14 in an electrostatic printing method for the production of ceramic decals.

18. The use of a toner according to claim 1 in an electrostatic printing method for the production of ceramic decals.

19. A two-part developer comprising a carrier and a ceramic toner, characterised in that said ceramic toner is present in an amount of 2 to 24 wt % of the developer and said toner comprises 50 to 85 wt % of inorganic ceramic colour and 50 to 15 wt % of polymeric material, said ceramic colour comprising a ceramic pigment and a glass frit.

20. A developer according to claim 19, wherein the toner comprises 65 to 75 wt % of inorganic ceramic colour.

21. A method for the production of inorganic ceramic toner particles, comprising the flocculation of an organic polymeric material from an aqueous suspension of said material and particles of an inorganic ceramic colour to yield ceramic toner particles having a desired content of ceramic colour in the range 60 to 90 wt %, said ceramic colour comprising a ceramic pigment and a glass frit.

22. A method according to claim 21, wherein the inorganic colour particles are of particle size of 0.1 to 20 μm.

23. A method according to claim 21 or 22, wherein the inorganic ceramic colour particles are of particle size of 0.1 to 20 μm.

* * * * *

UNITED STATES PATENT AND TRADEMARK OFFICE

CERTIFICATE OF CORRECTION

PATENT NO. : 6,110,632
DATED : Aug. 29, 2000
INVENTOR(S) : Dunford et al.

It is certified that error appears in the above-indentified patent and that said Letters Patent is hereby corrected as shown below:

On the Cover Page, under "FOREIGN PATENT DOCUMENTS", third reference identified, should read: "647885A1 9/1994 European Pat. Off. ."

Claim 23, column 18, line 62, after "claim 21" delete "or 22".

Signed and Sealed this

Fifteenth Day of May, 2001

*Attest:*

Nicholas P. Godici

NICHOLAS P. GODICI

*Attesting Officer*

*Acting Director of the United States Patent and Trademark Office*